US005896991A

United States Patent [19]

Hippely et al.

[11] Patent Number: 5,896,991

[45] Date of Patent: Apr. 27, 1999

[54] BLISTER CARD PACKAGE FOR HOLDING AND DISPLAYING SMALL ITEMS

[75] Inventors: Keith Alan Hippely, Manhattan Beach; William R. O'Keefe, Redondo Beach, both of Calif.

[73] Assignee: Mattel, Inc., El Segundo, Calif.

[21] Appl. No.: 08/909,780

[22] Filed: Aug. 12, 1997

[51] Int. Cl.[6] ..... B65D 85/00

[52] U.S. Cl. ..... 206/461; 206/467; 206/776; 206/781

[58] Field of Search ..... 206/461, 467, 206/468, 469, 470, 471, 775, 776, 778, 781

[56] References Cited

U.S. PATENT DOCUMENTS

| | | | |
|---|---|---|---|
| 511,088 | 12/1893 | Lunbeck et al. . | |
| 1,156,074 | 10/1915 | Hahn . | |
| 1,643,421 | 9/1927 | Rowan . | |
| 2,270,084 | 1/1942 | Schmidt . | |
| 2,549,023 | 4/1951 | Shinoda . | |
| 4,185,739 | 1/1980 | Wilford . | |
| 4,752,003 | 6/1988 | Miller et al. . | |
| 4,917,245 | 4/1990 | Wu | 206/471 |
| 4,993,547 | 2/1991 | Pallasch et al. . | |
| 5,060,798 | 10/1991 | Braastad . | |
| 5,064,056 | 11/1991 | Gresh | 206/471 X |
| 5,188,222 | 2/1993 | Pierce | 206/471 X |
| 5,411,138 | 5/1995 | Klawiter . | |

FOREIGN PATENT DOCUMENTS

| | | |
|---|---|---|
| 471746 | 9/1937 | United Kingdom . |
| 507644 | 6/1939 | United Kingdom . |
| 1419022 | 12/1975 | United Kingdom . |

*Primary Examiner*—Jacob K. Ackun
*Attorney, Agent, or Firm*—Roy A. Ekstrand

[57] ABSTRACT

A generally planar substantially rigid backing supports a transparent plastic blister on the front surface thereof. The blister defines an open rear portion and an encircling attachment flange. The lower edge of the attachment flange defines interleaved notches and tabs extending downwardly. The blister further defines a rib having an interior groove formed therein extending along each side and across the front portion of the blister. A generally planar support sheet formed of a rigid material defines a plurality of upwardly extending retainers having engagement apparatus formed therein. A cosmetic card formed of a decorative material defines a plurality of slots aligned with the retainers and is received upon the support sheet with the retainers passing through the slots. The retainers engage the to-be-packaged articles and secure them upon the cosmetic card. The support sheet includes a plurality of interleaved tabs and notches extending downwardly from the rear edge thereof. The tabs and notches of the blister and support sheet are offset to allow interleaving thereof and common attachment to the backing to secure the blister to the rigid backing.

15 Claims, 3 Drawing Sheets

FIG. 1
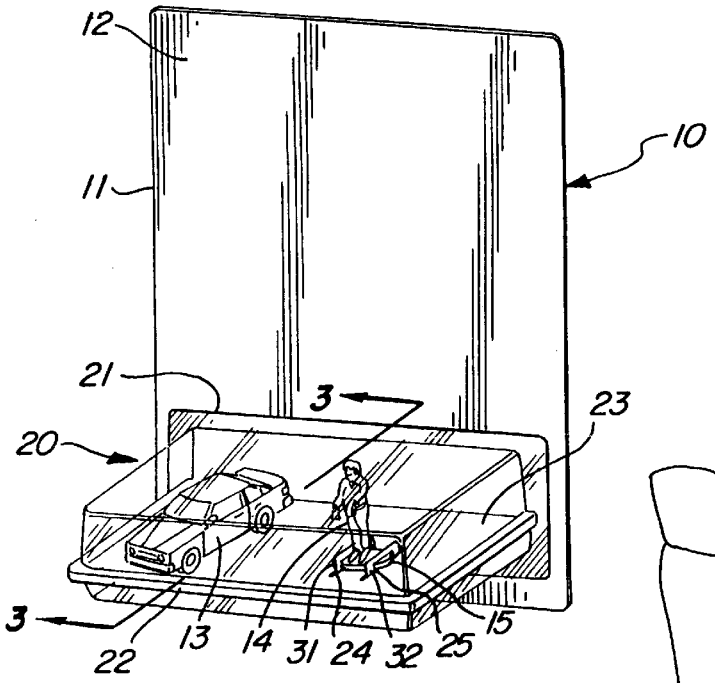
FIG. 5
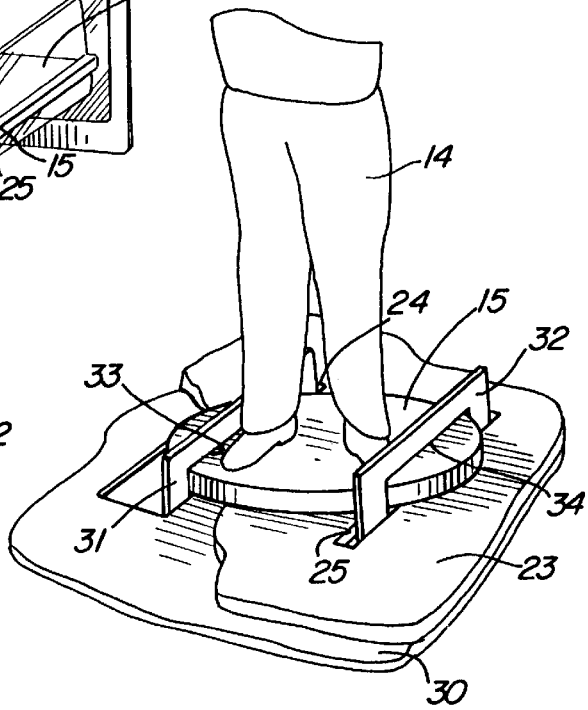
FIG. 6
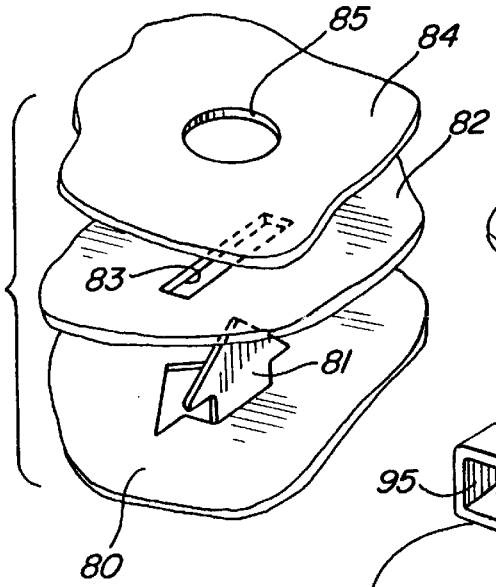
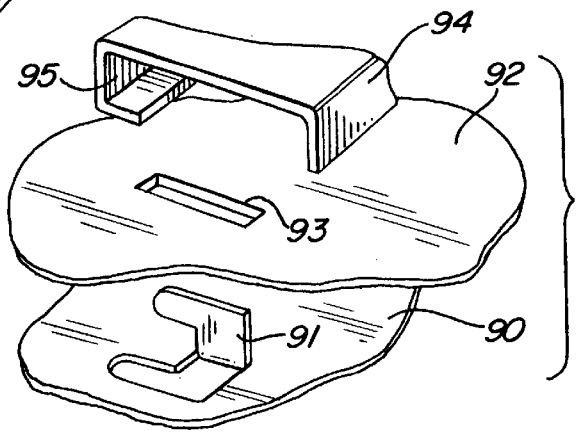
FIG. 7

BLISTER CARD PACKAGE FOR HOLDING AND DISPLAYING SMALL ITEMS

FIELD OF THE INVENTION

This invention relates generally to packaging utilized for small products or items and particularly to those generally known in the art as "blister packs".

BACKGROUND OF THE INVENTION

Blister card packaging has been developed in various forms through the years for providing a convenient packaging which facilitates displaying the packaged article upon shelves or hanging from shelf hangers. Such blister package use has greatly enhanced the attractiveness of displaying and handling small product articles such as small toys or the like. While the design of blister type packaging has varied substantially, the most common type of blister packaging utilizes a relatively stiff card or backing element usually printed with attractive designs and pleasing materials intended to catch the potential consumer's eye. The card or backing is generally configured to be hung from shelf hangers or able to stand on product shelves as needed. A clear plastic "blister" is secured to the card or backing and captivates the product therein. Early blister card packaging utilized blisters formed of relatively thin material which was vacuum drawn to generally conform to the product shape. This form to fit type blister typically defines an outer flange or lip which is glued to or otherwise secured to the card or backing.

Later developed blister card packages utilizes a decorative or aesthetically pleasing card hanger formed of a stiff cardboard material or the like together with a non form-fitting clear plastic "bubble" container. The non form-fitting bubble container is typically larger than the packaged product and thus various means have been utilized for securing and maintaining the product within the clear plastic container bubble. In many such packages, an interior platform often formed of a brightly colored or aesthetically interesting material is supported within the clear plastic bubble. With the advent of non form-fitting blister packaging, a need arose to secure the product to the interior platform. In most instances, conventional tie-down wires or "twist ties" are utilized. In other packaging systems, and interior form-fitting bubble is employed.

With increased pressure on manufacturers to more economically package their products and with increased need to package products in an attractive eye catching manner, a substantial number of different packaging configurations and designs have been created. For example, U.S. Pat. No. 5,411,138 issued to Klawiter sets forth a PACKAGING FOR A TOY having a bottom, top, front, back and sidewalls defining a box sized to receive a toy. The bottom surface of the box has an opening aligned with the toy slot so that a key may be passed through the bottom box opening into the toy's body and slot. Portions of the package are provided with clear transparent windows to facilitate viewing of the product.

U.S. Pat. No. 4,185,739 issued to Wilford sets forth RETENTION OF ARTICLES ON A SHEET having an assembly for an article, for example a toy vehicle, retained on a sheet in which the article is located on one side of the sheet and is held by a retainer. The retainer comprises a body portion of the opposite side of the sheet from the article and projections extend from the body portion such as a toy vehicle wheel set to engage recesses in the sheet.

U.S. Pat. No. 4,752,003 issued to Miller, et al. sets forth a BOOK AND MOUNTED CONTAINER having a book and a formed thin-walled hollow shell with one side thereof open and defining a flange closed by one of the book covers to form a closed container.

U.S. Pat. No. 4,993,547 issued to Pallasch, et al. sets forth a STACKABLE PIGGY BACK CARTON FOR BASKETBALL BACKBOARD AND RIM having positioning tabs on the package which position and hold a basketball rim on the backboard package.

U.S. Pat No. 5,060,798 issued to Braastad sets forth a PAPERBOARD HOLDER FOR FLOWER VASES AND THE LIKE having a paperboard or cardboard blank defining a plurality of upwardly foldable tabs configured to encircle the base of a vase or similar article. A tie string is passed through the upper portion of the tabs to encircle and confine the vase.

British Patent 471,746 sets forth IMPROVEMNTS IN DEVICES FOR CARRYING PRODUCTION THEREOF utilizing a generally planar cardboard or paper card having a plurality of apertures formed therein each having opposed tabs folded upward therefrom. The apertures and tabs are arranged in pairs to receive and captivate a plurality of pencils in a linear array.

British Patent 1,419,022 sets forth IMPROVEMENTS IN OR RELATING TO PACKAGING having a combination of a tubular or box-like carton receiving an article to be packaged. The carton defines end panels which extend through slots formed in the back panel of the product carton to foldably secure the product carton.

British Patent 507,644 sets forth IMPROVEMENTS IN AND RELATING TO SUPPORTS FOR DISPLAY CARDS FOR ARTICLES having a planar support card defining a plurality of apertures having folded tabs extending outwardly therefrom. The apertures and tabs are arranged in a linear arrangement to facilitate holding an article such as a comb or the like. The rear portion of the card supports a foldable support stand element for positioning and supporting the card display upon a suitable display surface.

U.S. Pat. No. 2,549,023 issued to Shinoda sets forth a CONTAINER FOR CUT FLOWERS having a transparent blister secured to a backing formed of a paper or cardboard. A foldable tab is formed in the backing which defines a slot to receive the stem of a flower or the like.

U.S. Pat. No. 2,270,084 issued to Schmidt sets forth a DISPLAY DEVICE for supporting and displaying articles such as toy soldiers having support pedestals. The display device includes a generally planar paperboard or cardboard having a plurality of apertures and folding tabs defined therein. The apertures receive the pedestals of the soldiers while the folding tabs secure the pedestals in place.

U.S. Pat. No. 511,088 issued to Lunbeck, et al. sets forth an EXHIBITING DEVICE adapted to hold and display irregular forms such as mineral specimens or the like.

U.S. Pat. No. 1,156,074 issued to Hahn sets forth a PACKING CASE FOR FRAGILE ARTICLES while U.S. Pat. No. 1,643,421 issued to Rowan sets forth a DISPLAY CARD for securing a doll or toy figure having folding tabs extending from a generally planar support base.

While the foregoing described prior art devices as well as the above-described conventional blister packaging have, in some instances provided improvement in the art and in some instances enjoyed commercial success, there remains a continuing need in the art for a blister package system which provides optimum display and attractiveness of the packaged article while maintaining the article securely within the blister pack without the need of unattractive and inefficient tie-downs or twist ties.

SUMMARY OF THE INVENTION

Accordingly, it is a general object of the present invention to provide an improved blister card package. It is a more particular object of the present invention to provide an improved blister card package for holding and displaying small items which securely maintains the small item within a non form-fitting blister.

In accordance with the present invention, there is provided a package and small item in combination, the combination comprising: a small item having engagement means; a generally planar backing having a front surface; a blister, formed of a light-transmissive material, defining an enclosure having an open rear portion and first attachment means for attaching the blister to the front surface; a support sheet defining a plurality of upwardly extending retainers received within the enclosure; and a cosmetic sheet overlying the support sheet and defining apertures through which the retainers pass to extend upwardly beyond the cosmetic sheet, the small item being held above the cosmetic sheet by the cooperation of the engagement means and the retainers and the blister being secured to the front surface by the first attachment means covering the open rear portion.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 1 sets forth a perspective view of a blister card package for holding and displaying small items;

FIG. 5 sets forth a partial perspective view of the figure attachment apparatus of the present invention package;

FIG. 6 sets forth a partial perspective assembly view of an alternate product attachment constructed in accordance with the present invention; and FIG. 7 sets forth a partial perspective assembly view of a still further alternate product attachment apparatus constructed in accordance with the present invention.

DESCRIPTION OF THE PREFERRED EMBODIMENTS

Figure 2:
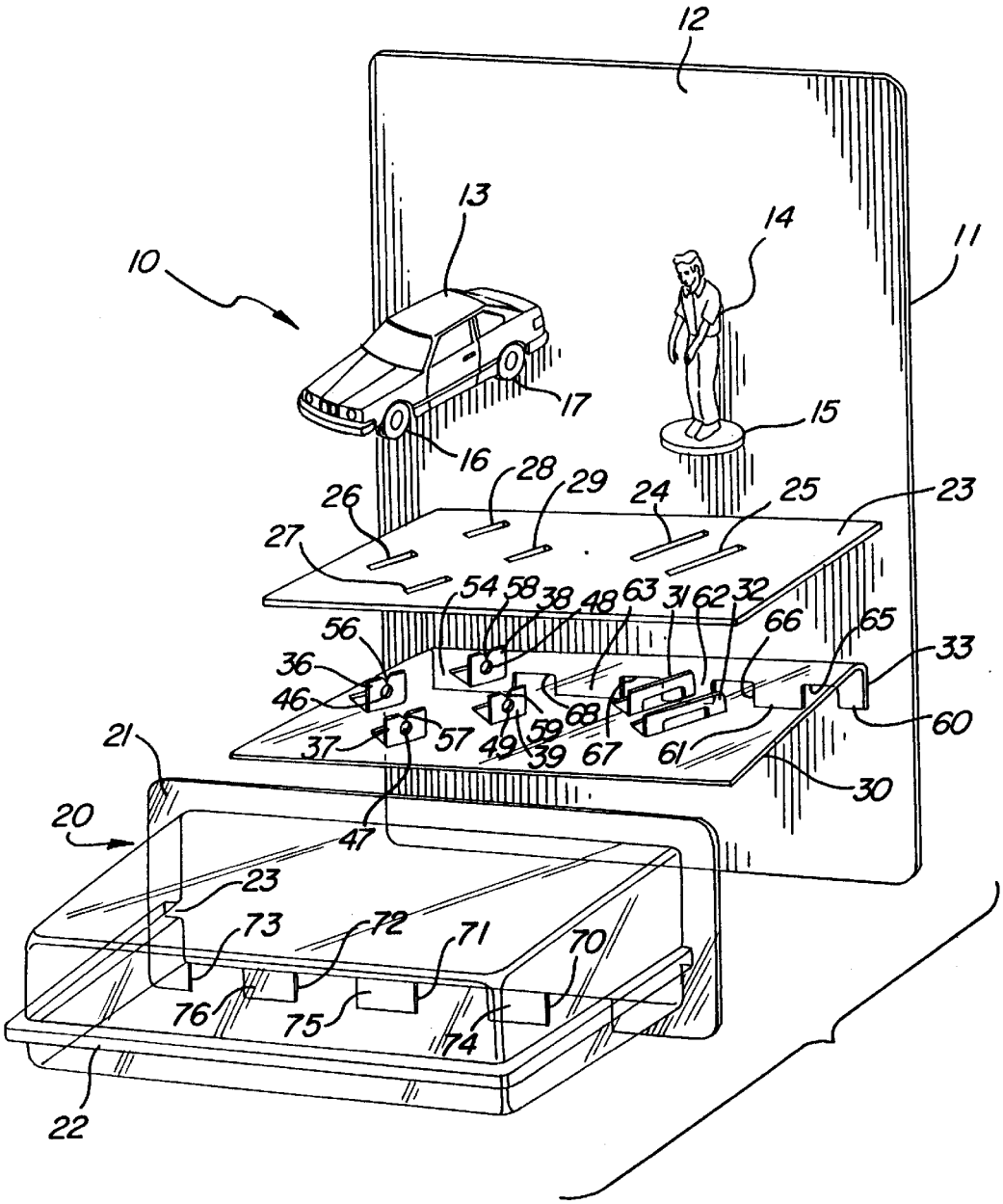
FIG. 2 sets forth a perspective assembly view of the package of FIG. 1.

FIG. 1 sets forth a perspective view of a package constructed in accordance with the present invention supporting a pair of toy articles. The present invention package of FIG. 1 is generally referenced by numeral 10 and includes a generally planar backing 11 preferably formed of a rigid paperboard or cardboard. Backing 11 includes a front surface 12 which in a typical product packaging environment supports an aesthetically appealing design or image intended to attract the attention of a would-be purchaser. Package 10 further includes a non formfitting blister 20 preferably formed of a clear plastic material or the like. Blister 20 is generally rectangular in shape and defines an attachment flange 21 generally orthogonal to the top, bottom and side surfaces of blister 20. Blister 20 is open at its rear side and further defines a rib 22 which extends along each side and across the front portion of blister 20. As is better seen in FIG. 2, rib 22 defines an internal groove 23. While rib 22 operates to substantially strengthen blister 20, its primary purpose is to receive the front and side edges of support sheet 30 and cosmetic card 23 (the former seen in FIG. 2 and provide secure support for a toy article 23 and a toy FIG. 14 secured within blister 20 by means set forth below in greater detail. Suffice it to note here, however, that attachment flange 21 is secured to front surface 12 of backing 11 using conventional adhesives or the like to provide secure attachment of blister 20 to backing 11. In the attachment of blister 20 to backing 11, cosmetic card 23 and the underlying support sheet (support sheet 30 shown in FIG. 2) are secured within blister 20.

In accordance with the present invention and by means set forth below in greater detail, a toy vehicle 13 is secured to cosmetic card 23 and support sheet 30 (seen in FIG. 2) to maintain toy vehicle 13 securely within blister 20. of importance with respect to the present invention is the substantially invisible attachment of toy vehicle 13 and thus the free and open display of the toy vehicle within blister 20 to maximize customer appeal. Cosmetic card 23 which in a typical packaging application supports a decorative and aesthetically pleasing image further defines a pair of elongated slots 24 and 25. By means set forth below in greater detail, a pair of retainers 31 and 32 are supported beneath cosmetic card 23 and extend upwardly through slots 24 and 25. A toy FIG. 14 having a support pedestal 15 is secured to cosmetic card 23 by the engagement of retainers 31 and 32 in the manner shown in FIG. 5.

FIG. 2 sets forth a perspective assembly view of the present invention package embodiment shown in FIG. 1. Also shown in FIG. 2 are a pair of typical toy articles. Thus, a conventional toy vehicle 13 having a plurality of support wheels such as front wheel 16 and rear wheel 17 are shown within package 10 together with a toy FIG. 14 having a pedestal 15.

Package 10 includes a substantially rigid backing 11 preferably formed of a stiff paperboard or cardboard material and having a front face 12. Front face 12 typically defines an aesthetically pleasing and attractive image printed thereon intended to enhance customer appeal of the package. Package 10 further includes a generally rectangular cosmetic card 23 preferably formed of a stiff paperboard or cardboard material which may support an aesthetically pleasing image to further enhance the package attractiveness to the potential purchaser. Cosmetic card 23 further defines a pair of slots 24 and 25 together with a quartet of slots 26 through 29. Slot 24 and 25 are utilized in securing toy FIG. 14 while slots 26 through 29 are utilized in securing toy vehicle 13.

In further accordance with an important aspect of the present invention, package 10 further includes a support sheet 30 having a generally planar portion and a downwardly extending attachment flange 33. Support sheet 30 defines a pair of upwardly extending retainers 31 and 32 together with a quartet of upwardly extending retainers 36 through 39. Retainers 31 and 32 as well as retainers 36 through 39 are formed by cutting generally U-shaped portions of support sheet 30 and bending the resulting tab upwardly as shown in FIG. 2. Cosmetic card 23 is sized and configured to rest upon the horizontal portion of support sheet 30. Accordingly, and is further accordance with the present invention, the positions of retainers 31 and 32 with respect to slots 24 and 25 are aligned such that retainers 31 and 32 pass upwardly through slots 24 and 25 as cosmetic card 23 is laid upon support sheet 30. Similarly, retainers 36 through 39 are aligned with slots 26 through 29 respectively of cosmetic card 23 and thus pass through slots 26 through 29 when card 23 is placed upon support sheet 30. In further accordance with the present invention, attachment flange 33 defines a plurality of downwardly extending tabs 60, 61, 62, 63 and 64 together with a plurality of interleaved notches 65, 66, 67 and 68. Support sheet 30 is preferably formed of a relatively rigid material and for aesthetic reasons is preferably formed of a clear plastic material similar to that forming blister 20.

Package 10 further includes a generally rectangular blister 20 formed of a clear plastic material and defining a substantially rectangular interior cavity having an open rearward side. An attachment flange 21 surrounds the open rear side of blister 20. Blister 20 further defines a rib 22 having an interior groove 23 formed therein. Rib 22 extends along each side and across the front portion of blister 20. The lower edge of attachment flange 21 defines a plurality of downwardly extending tabs 74, 75 and 76 together with interleaved notches 70, 71, 72 and 73.

Package 10 is assembled to package toy vehicle 13 and toy FIG. 14 by initially placing cosmetic card 23 upon the horizontal portion of support sheet 30 such that retainers 31 and 32 pass through slot 24 and 25 and retainers 36 through 39 pass through slots 26 through 29 respectively. Thereafter, toy FIG. 14 is secured within retainers 31 and 32 in the manner set forth below in FIG. 5 in greater detail. Suffice it to note here that pedestal 15 is secured within the slots of retainers 31 and 32 captivating pedestal 15 against cosmetic card 23. In further accordance with the present invention, toy vehicle 13 is secured to retainers 36 through 39 in the manner set forth below in FIG. 3 in greater detail. In accordance with the present invention, retainers 36 through 39 define respective apertures 46 through 49. Retainers 36 through 39 further define respective slits 56 through 59 respectively which extend into apertures 46 through 49. While the attachment of vehicle 13 to retainers 36 through 39 is set forth in FIG. 3 in greater detail, suffice it to note here that vehicle 13 in accordance with conventional fabrication techniques defines a front axle and a rear axle supporting its respective front and rear wheels. Accordingly, retainers 36 through 39 are received directly inward of each of the front and rear wheels of vehicle 13 such that the respective front and rear axles of the toy vehicle (not shown) are passed through slits 56 through 59 to be received within apertures 46 through 49. The resilience of the material from which retainers 36 through 39 are formed causes slits 56 through 59 to close once the toy vehicle axles have passed therethrough captivating toy vehicle 13 against cosmetic card 23 in a secure and substantially invisible attachment.

Once the combination of cosmetic card 23, support sheet 30, toy vehicle 13 and toy FIG. 14 has been assembled, the combined assembly is inserted into blister 20 through the open rear side thereof. During this insertion, both cosmetic card 23 and support sheet 30 are received within groove 23 of rib 22. This provides secure support and attachment between cosmetic card 23 and support sheet 30 and blister 20 on the respective sides and front portions thereof. Once support sheet 30 and cosmetic card 23 are fully inserted into the interior of blister 20, attachment flange 33 is received against the lower portion of attachment flange 21 in the manner set forth below in FIGS. 3 and 4. Suffice it to note here that the lower portion of attachment flange 33 defines a plurality of interleaved notches and tabs. Similarly, it will be noted that the lower portion of attachment flange 21 of blister 20 defines an offset plurality of interleaved notches and tabs. Thus, as is better seen in FIG. 4, the assembly of support sheet 30 into blister 20 provides alignment of tabs 61 through 64 with notches 70 through 73 respectively of attachment flange 21. The combined structure of support sheet 30, cosmetic sheet 23, toy vehicle 13, toy FIG. 14 and blister 20 may then be assembled to front surface 12 of backing 11 by applying appropriate adhesive to attachment flange 21 and attachment flange 23 to adhesively bond attachment flanges 21 and 33 to front surface 12. In accordance with an important aspect of the present invention, the fabrication of alternate offset tabs and notches on attachment flange 21 of blister 20 and attachment flange 33 of support sheet 30 facilitates the secure attachment of the rear edge of support sheet 30 and the attachment flange of blister 20.

With the assembly of package 10 complete, toy vehicle 13 and toy FIG. 14 are securely mounted upon cosmetic card 23 in a low visibility attachment which maximally displays the toy articles while maintaining security of toy article attachment within blister 20. It will be recognized by those skilled in the art that cosmetic card 23 and front surface 12 of backing 11 may employ a suitable set of visible images to coordinate with and enhance the appearance of toy vehicle 13 and toy FIG. 14. It will be equally apparent to those skilled in the art that while the example set forth in FIGS. 1 and 2 of the present invention package are utilized in securing a toy vehicle and a toy figure, the present invention packaging may be utilized to package a virtually endless variety of articles within blister 20.

Figure 3:
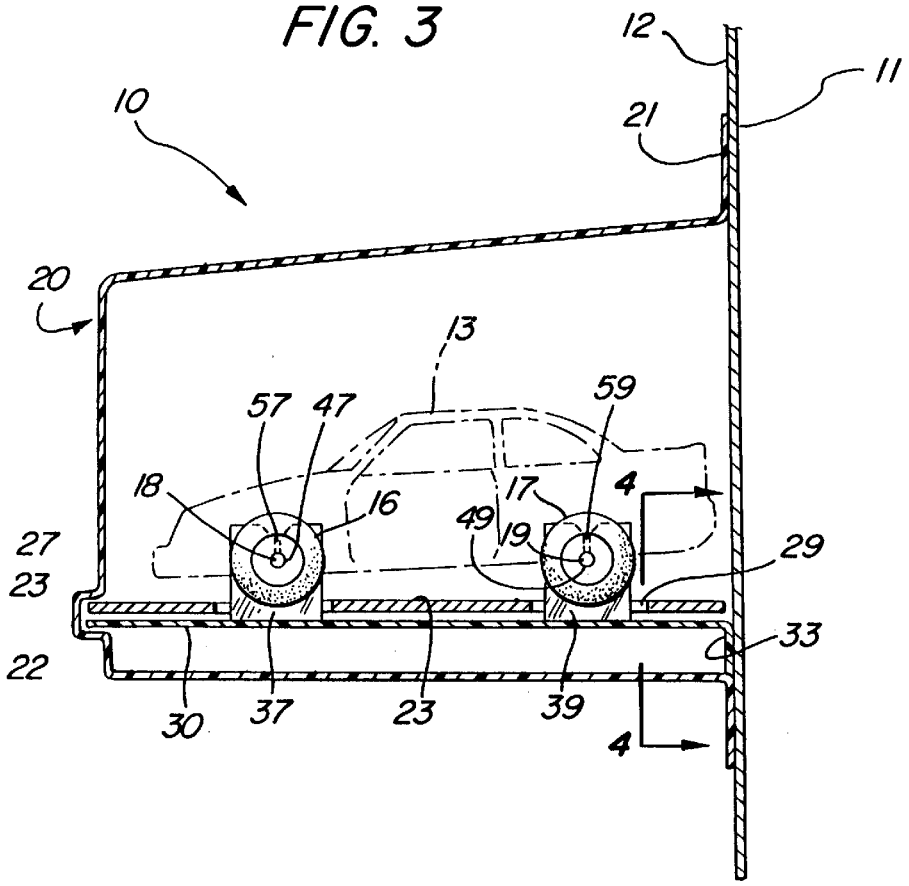
FIG. 3 sets forth a section view of the present invention package taken along section lines 3—3 in FIG. 1.

FIG. 3 sets forth a section view of the present invention package taken along section lines 3—3 in FIG. 1. For purposes of illustration and to avoid unduly cluttering the drawing, toy vehicle 13 is shown in dashed-line phantom in FIG. 3. Thus, as described above, package 10 includes a backing 11 defining a front surface 12. Package 10 further includes a blister 20 formed of a clear plastic material or the like defining an attachment flange 21. Blister 20 further defines a rib 22 forming an interior groove 23 along the sides and front portion of blister 20 (better seen in FIG. 2). Within blister 20, a generally planar support sheet 30 is received within interior groove 23 of rib 22 and secured to front surface 12 of backing 11 by an attachment flange 33. As described above, attachment flange 33 is preferably secured to surface 12 using a conventional adhesive attachment or the like. As is also described above, attachment flange 33 of support sheet 30 and attachment flange 21 of blister 20 define interleaved offset notches and tabs facilitating the common attachment to front surface 12 in a manner supporting the rear edge of support sheet 32 against backing 11. As is also described above, cosmetic card 23 defines a plurality of elongated slots such as slots 27 and 29 through which a corresponding plurality of retainers such as retainers 37 and 39 formed in support sheet 30 pass upwardly to engage their respective toy article. Thus, retainers 37 and 39 formed in support sheet 30 extend upwardly through slots 27 and 29 respectively. Retainers 37 and 39 define respective apertures 47 and 49 together with respective vertical slits 57 and 59. As mentioned above, support sheet 30 is preferably formed of a rigid material such as plastic or the like and thus retainers 37 and 39 are similarly rigid and resilient. The resilience of retainers 37 and 39 is important in that the front and rear axles of toy vehicle 13 may be passed through the slits formed in the retainers allowing the front and rear axles to be engaged and captivated by the retainers. More specifically and by way of illustration, retainer 37 receives front axle 18 of vehicle 13 by passing retainer 37 upwardly behind wheel 16 such that axle 18 passes through slit 57 and is received within aperture 47. Similarly retainer 39 passes upwardly on the inside of rear wheel 17 of vehicle 13 such that rear axle 19 of the toy vehicle is passed through slit 59 and is received and captivated within aperture 49. While not seen in the section view of FIG. 3, it will be understood with temporary reference to FIG. 2 that a similar attachment takes place between retainer 36 and front axle 18 of toy vehicle 13 as well as a similar attachment between retainer 38 and rear axle 19 of toy vehicle 13 to fully secure the toy vehicle.

Returning to FIG. 3, it will be seen that the combination of groove 23 within rib 22 of blister 20 and the adhesive attachment of attachment flange 33 and attachment flange 21 to backing 11 cooperate to securely attach support sheet 30, cosmetic card 23 and toy vehicle 13 together with toy FIG. 14 (seen in FIG. 2) within the interior of blister 20.

Figure 4:
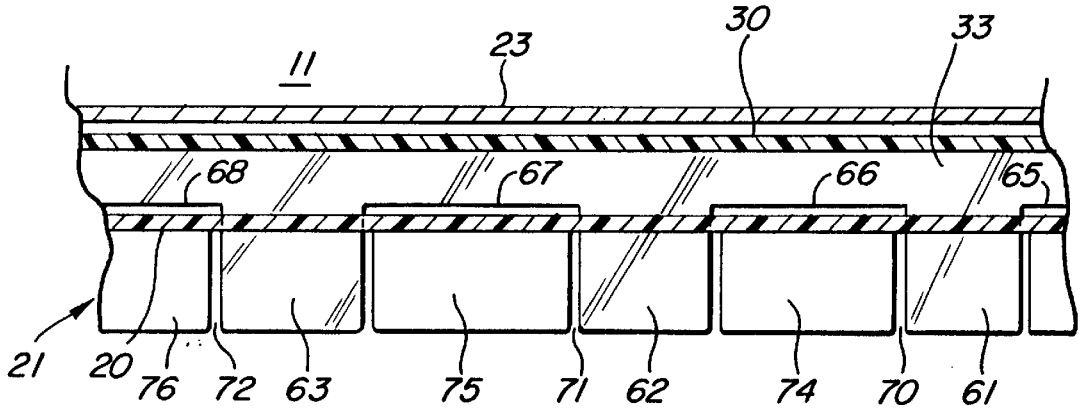
FIG. 4 sets forth a partial section view of the present invention package taken along section lines 4—4 in FIG. 3.

FIG. 4 sets forth a partial section view of package 10 taken along section lines 4—4 in FIG. 3. The importance of FIG. 4 is to more clearly show the offset interleaved tabs and notches of attachment flange 33 of support sheet 30 and attachment flange 21 of blister 20. This interleaved tab and notch arrangement provides an interlocking high strength attachment for both attachment flanges along a common adhesive attachment line.

More specifically, FIG. 4 sets forth cosmetic sheet 23 resting upon support sheet 30. Support sheet 30 includes an attachment flange 33 having a plurality of downwardly extending tabs 61, 62 and 63 interleaved with notches 65, 66, 67 and 68. Also seen in FIG. 4, blister 20 defines a downwardly extending attachment flange 21 which defines a plurality of notches 70, 71 and 72 together with offset tabs 74, 75 and 76. The offset alignment between notches and tabs of attachment flange 33 of support sheet 30 and attachment flange 21 of blister 20 provide the extension of tabs 61, 62 and 63 of attachment flange 33 into notches 70, 71 and 72 of attachment flange 21 of blister 20. As a result, the combined plurality of tabs from both attachment flange 33 and attachment flange 21 may be commonly secured to backing 11 along a common adhesive attachment line. This common attachment secures the relative position of support sheet 30 along its rear edge without additional manufacturing steps and provides substantial advantage for the present invention blister package.

FIG. 5 sets forth a partial perspective view of the attachment of toy FIG. 14. As described above, a cosmetic card 23 defining slots 24 and 25 is received upon support sheet 30. Support sheet 30 in turn defines upwardly extending retainers 31 and 32 having respective slots 33 and 34 formed therein. Because retainers 31 and 32 pass through slots 24 and 25 of cosmetic card 23 and because pedestal 15 of toy FIG. 14 is secured within slots 33 and 34 of retainers 31 and 32, toy FIG. 14 is secured to support sheet 30 in a manner captivating cosmetic card 23 upon the support sheet. Additionally, however, it may be desirable in certain fabrications to further attach cosmetic card 23 to support sheet 30 using adhesive attachment or other bonding apparatus.

FIG. 6 sets forth a partial perspective assembly view of an alternate embodiment of the present invention for securing a toy article 84. In the embodiment of FIG. 6, a support sheet 80 is fabricated in substantially the same manner as support sheet 30 described above and is received within a blister such as blister 20 in substantially the same manner as is also described above. In the embodiment of FIG. 6, however, a retainer 81 having an arrow head like shape is cut from support sheet 80 and folded upwardly. A cosmetic sheet 82, substantially the same as cosmetic sheet 23 described above, defines an aligned slot 83 through which retainer 81 passes as cosmetic sheet 82 is rested upon support sheet 80. In the embodiment of FIG. 6, toy article 84 defines an aperture 85. Toy article 84 is thus secured to support sheet 30 overlying cosmetic sheet 82 as retainer 81 is forced through aperture 85. Once retainer 81 passes through aperture 85 it deforms and then, due to its resilience, reassumes the shape shown in FIG. 6 to captivate toy article 84.

FIG. 7 set forth a partial perspective assembly view of a still further alternate embodiment of the present invention package. A support sheet 90 substantially identical to support sheet 30 shown above with the exception of a differently shaped retainer 91 receives a cosmetic sheet 92 substantially identically to cosmetic sheet 23 set forth with the exception of an aligned slot 93 formed therein.

Retainer 91 extends upwardly through slot 93 and engages a channel 95 formed in a toy article 94. The resilience of retainer 91 allows retainer 91 to extend into and engage channel 95 to secure toy article 94.

It will be apparent to those skilled in the art that while the present invention package has been shown utilized in packaging and securing various toy articles, it is equally applicable to other small item blister packaging product situations. Thus, other articles besides toy articles will be understood to be capable of packaging within the present invention blister package.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A package and small item in combination, said combination comprising:

a small item having engagement means;

a generally planar backing having a front surface;

a blister, formed of a light-transmissive material, defining an enclosure having an open rear portion and first attachment means for attaching said blister to said front surface;

a support sheet defining a plurality of upwardly extending retainers received within said enclosure; and a cosmetic sheet overlying said support sheet and defining apertures through which said retainers pass to extend upwardly beyond said cosmetic sheet;

said small item being held above said cosmetic sheet by the cooperation of said engagement means and said retainers and said blister being secured to said front surface by said first attachment means covering said open rear portion.

2. The combination of claim 1 wherein said small item is a toy vehicle having front and rear axles providing said engagement means and wherein said retainers each define means for engaging said axles.

3. The combination of claim 2 wherein said means for engaging said axles includes an aperture formed in each of said retainers and a slit extending outwardly from each of said apertures.

4. The combination of claim 1 wherein said small item is a toy figure having a pedestal providing said engagement means and wherein said retainers each define a slot for grasping a portion of said pedestal.

5. The combination of claim 1 wherein said small item engagement means includes an aperture and wherein each of said retainers define a barbed arrowhead for passing through said aperture and engaging said small item.

6. The combination of claim 1 wherein said blister defines an internal groove and wherein portions of said support sheet define edges received therein.

7. The combination of claim 1 wherein said first attachment means includes an outwardly extending first flange encircling said open rear portion attached to said front surface.

8. The combination of claim 7 wherein said support sheet defines second attachment means for attaching said support sheet to said front surface.

9. The combination of claim 8 wherein said blister defines an internal groove and wherein portions of said support sheet define edges received therein.

10. The combination of claim 9 wherein said second attachment means includes a second flange attached to said front surface.

11. The combination of claim 10 wherein said first flange defines a first plurality of interleaved notches and tabs and wherein said second flange defines a second plurality of notches and tabs offset from said first plurality of notches and tabs, said tabs of said second plurality extending through said notches of said first plurality.

12. A package and small item in combination, said combination comprising:

a small item;

a blister package having a backing and a light-transmissive blister, defining an enclosure, secured to said backing;

a support member received within said enclosure having a plurality of upwardly extending retainers for engaging said small item; and a cosmetic member overlying said support member having apertures therein, said retainers passing through said apertures.

13. The combination of claim 12 wherein said small item is a toy vehicle having plural wheels and axles and wherein said retainers extend to and engage said axles passing inwardly of said wheels.

14. The combination of claim 12 wherein said blister defines an internal groove and wherein portions of said support sheet define edges received therein.

15. The combination of claim 14 wherein said support member and said cosmetic member each define respective side and front edges received within said internal groove.

* * * * *